US006192800B1

(12) United States Patent
DeMoore et al.

(10) Patent No.: US 6,192,800 B1
(45) **Date of Patent: *Feb. 27, 2001**

(54) METHOD AND APPARATUS FOR HANDLING PRINTED SHEET MATERIAL

(75) Inventors: Howard Warren DeMoore, Dallas; John Andrew Branson, Coppell, both of TX (US)

(73) Assignee: Howard W. DeMoore, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/379,722

(22) Filed: Jan. 27, 1995

Related U.S. Application Data

(63) Continuation-in-part of application No. 08/259,634, filed on Jun. 14, 1994, now Pat. No. 6,119,597.

(51) Int. Cl.[7] ..... B41L 15/10
(52) U.S. Cl. ..... 101/483; 101/232
(58) Field of Search ..... 101/220, 229, 101/230, 231, 232, 416.1, 419, 420, 483

(56) References Cited

U.S. PATENT DOCUMENTS

| | | | | |
|---|---|---|---|---|
| 3,791,644 | | 2/1974 | DeMoore | 271/80 |
| 3,901,016 | * | 8/1975 | Hurley | 57/162 |
| 4,402,267 | | 9/1983 | DeMoore | 101/419 |
| 4,599,943 | | 7/1986 | Kobler | 101/217 |
| 4,665,823 | | 5/1987 | Hightower | 101/232 |
| 4,673,380 | | 6/1987 | Wagner | 474/90 |
| 5,042,384 | | 8/1991 | DeMoore et al. | 101/483 |
| 5,243,909 | * | 9/1993 | DeMoore et al. | 101/232 |
| 5,320,042 | * | 6/1994 | Schwopfinger | 101/416.1 |

* cited by examiner

*Primary Examiner*—Ren Yan
(74) *Attorney, Agent, or Firm*—Locke Liddell & Sapp LLP

(57) ABSTRACT

A support cylinder for guiding freshly processed substrate material between printing units or at the delivery end of a printing press is provided with a low coefficient of friction, semi-conductive covering for supporting and transporting the freshly processed substrate material without smearing the ink or causing indentations on the surface of the substrate. Radially projecting surface portions define electrostatic precipitation points and reduce the surface area available for frictional engagement. The low friction and electrostatically neutral properties of the semi-conductive base covering permit free movement of the freshly processed substrate relative to the support cylinder surface. Electrostatic charges carried by the processed substrate are discharged through the semi-conductive base covering into the support cylinder, thus eliminating electrostatic cling attraction between the freshly processed substrate and the support cylinder.

43 Claims, 6 Drawing Sheets

METHOD AND APPARATUS FOR HANDLING PRINTED SHEET MATERIAL

CROSS-REFERENCE TO RELATED APPLICATION

This application is a continuation-in-part of U.S. patent application Ser. No. 08/259,634, filed Jun. 14, 1994, now U.S. Pat. No. 6,119,597.

FIELD OF THE INVENTION

This invention concerns method and apparatus for providing improved support for freshly printed sheet material in a printing press.

BACKGROUND OF THE INVENTION

In the operation of a multi-unit rotary offset printing press, freshly printed sheets are transported by transfer devices from one printing unit to another, and then they are delivered to a sheet stacker. Sheet transfer devices are known by various names including transfer cylinders, support rollers, delivery wheels, delivery cylinders, skeleton wheels, transfer drums, support wheels, guide wheels and the like. The ink marking problems inherent in transferring freshly printed sheets have been longstanding. In order to minimize the contact area between the transfer cylinder and the printed sheet, conventional support wheels have been modified in the form of relatively thin disks having a toothed or serrated circumference, referred to as skeleton wheels. However, those types of wheels have not overcome the problems of smearing and marking the printed surface of the printed sheet material due to sliding action between the printed sheet material and the projections or serrations. Moreover, the attempts to minimize the surface support area in contact with the sheet material has also resulted in actual indenting or dimpling of the material itself.

DESCRIPTION OF THE PRIOR ART

Various efforts have been made to overcome the disadvantages of thin disk skeleton wheels. One of the more successful approaches has been completely contrary to the concept of minimizing the surface area of contact. That improvement is disclosed and claimed in my U.S. Pat. No. 3,791,644 wherein I provide for a substantially cylindrical wheel or roller coated with an improved ink repellent surface formed by a layer of polytetrafluoroethylene (PTFE). During the use of the PTFE coated cylinder in high speed commercial printing equipment, the surface of the coated cylinder must be washed relatively frequently with a solvent to remove any ink accumulation.

The limitations on the use of the conventional skeleton wheel and PTFE coated transfer cylinder have been overcome with a transfer cylinder having an ink repellent and supportive flexible jacket covering or the like for handling the freshly printed sheet material. It is now well recognized and accepted in the printing industry world-wide that marking and smearing of freshly printed sheets caused by engagement of the wet printed surface against the supporting surface of a conventional press transfer cylinder is substantially eliminated by using the anti-marking flexible covering system as disclosed and claimed in my U.S. Pat. No. 4,402,267 entitled "Method and Apparatus for Handling Printed Sheet Material", the disclosure of which is incorporated herein by reference. That system, which is marketed under license by Printing Research, Inc. of Dallas, Tex. under the registered trademark "SUPER BLUE", includes a movable covering or jacket of flexible material, referred to as a "flexible jacket covering". The flexible jacket covering provides a yieldable, cushioning support for the freshly printed side of the printed sheet such that any relative movement between the printed sheet and the transfer cylinder surface takes place between the surface of the flexible jacket covering and the support surface of the cylinder so that marking and smearing of the freshly printed surface is substantially reduced.

Although the improved "SUPER BLUE" transfer cylinder has achieved world-wide commercial success, with continuous use such as is common in many printing operations, there is over a period of time a slight accumulation of ink on the surface of the flexible jacket covering. Moreover, some presses do not have sufficient cylinder clearance to accommodate the flexible jacket covering.

Investigation and testing has identified the accumulation of an electrostatic charge on the freshly printed sheets as a factor which tends to impede completely free movement of the printed sheets as they are pulled around the transfer cylinder. The electrostatic charge build-up also appears to cause a faster accumulation of ink so that the support surfaces of the transfer cylinder becomes ink encrusted and needs to be changed more frequently. The build-up of the static electric charge on the freshly printed sheets is caused by "frictional electricity", which is the transfer of electrons from one material to another when they are pressed or rubbed together.

According to one theory, the transfer of electrostatic charges between two contacting dielectrics, such as the metal press parts and a paper or other substrate sheet, is proportional to the difference between their dielectric constants, with the electrostatic charge moving from the material having the lower dielectric constant to the material having the higher dielectric constant. Since metal has a lower dielectric constant as compared with paper, an electrostatic charge is picked up by the sheets of paper from frictional contact with metal press parts as the sheets travel through the press.

Those transfer cylinders whose transfer surface is covered by a synthetic or natural organic resin, for example, as disclosed in my U.S. Pat. No. 4,402,267, have a low-friction surface but also have electrical insulating, dielectric properties which make them an accumulator of electrostatic charges carried by the printed sheets. That is, the electrical charge which is transferred to the printed sheets is also transferred to the underlying low friction, electrically insulating dielectric covering. As a consequence of such electrostatic charge transfer and accumulation, the freshly printed sheets tend to cling to the underlying cylinder base covering surface and do not move as freely because of the force of electrostatic attraction between the printed sheet material and the electrically insulating cylinder base covering.

SUMMARY OF THE INVENTION

We have discovered that virtually smear-free sheet transfer can be obtained without using a flexible jacket covering as disclosed in U.S. Pat. No. 4,402,267. Smear-free sheet transfer is accomplished by a base covering of electrically semi-conductive material having a frictional coefficient which is less than the frictional coefficient of the transfer cylinder sheet support surface. The detrimental effect of electrostatic charge accumulation on the freshly printed sheets is prevented by interposing a layer or covering of semi-conductive material having a low coefficient of friction which is less than the coefficient of friction of the transfer cylinder surface, whereby electrostatic charges carried by the freshly printed sheet material are discharged through the semi-conductive layer or covering into the grounded transfer or delivery cylinder. Consequently, the build-up or accumulation of electrostatic charges on the semi-conductive covering cannot occur, since such charges are conducted immediately from the printed sheet through the semi-conductive base covering into the transfer cylinder and into the grounded frame of the printing press.

In accordance with one aspect of the present invention, radially projecting surface portions on the semi-conductive base covering define electrostatic precipitation points and reduce the surface area available for frictional engagement. The low friction properties of the semi-conductive base covering permit free movement of the freshly printed sheets relative to the transfer cylinder surface. Electrostatic charges carried by the printed sheet material are discharged into the transfer cylinder through the semi-conductive base covering.

In accordance with another aspect of the present invention, movement of the freshly printed sheets relative to the transfer cylinder is improved by a base covering of a low frictional coefficient material disposed on the sheet support surface of the transfer cylinder. The low frictional coefficient base covering material has a frictional coefficient which is less than the frictional coefficient of the sheet support surface, and has radially projecting surface portions which reduce the surface area available for frictional engagement. The surface of the base covering material is structurally differentiated and is characterized by radially projecting portions which reduce the amount of surface area available for contact with the freshly printed sheets.

The structurally differentiated, radially projecting surface portions are provided by weft and warp strands of woven material in one embodiment, and by nodes or beads in an alternative embodiment. The structurally differentiated base covering embodiment is useful for reducing the frictional drag imposed against the freshly printed sheets. It is not necessary that the structurally differentiated base covering embodiment be rendered conductive, where other means such as a conductive wire or foil or the like is used in the press for discharging electrostatic charges carried by the printed sheets. A cylinder base covering having a structurally differentiated surface thus has utility for reducing frictional drag in the non-conductive embodiment, and also has utility for enhancing electrostatic discharge from the freshly printed sheets in the conductive embodiment.

According to another aspect of the present invention, the low coefficient of friction, conductive base covering for the transfer cylinder comprises a woven fabric of polyamide fiberglass strands coated with an organic fluoropolymer which contains a conductive agent such as carbon black, graphite or the like. The freshly printed sheets engage radially projecting strand portions of the woven covering without marking the freshly printed surface or damaging the sheet material itself.

In accordance with another embodiment of the present invention, the cylindrical support surface of the transfer cylinder is covered by a layer of semi-conductive fluoropolymer resin which forms a low friction, electrically semi-conductive supporting surface. In this embodiment, the surface of the semi-conductive layer is structurally differentiated by nodes or beads.

These and other features and advantages of the present invention will become apparent to those skilled in the art upon reading the following detailed description with reference to the drawings wherein there is shown and described exemplary embodiments of the invention.

DETAILED DESCRIPTION OF THE PREFERRED EMBODIMENTS

As used herein, the term "processed" refers to various printing methods which may be applied to either side or both sides of a substrate, including the application of aqueous inks, protective coatings and decorative coatings. The term "substrate" refers to sheet material or web material.

Also, as used herein, "fluoropolymer" means and refers to fluorocarbon polymers, for example polytetrafluoroethylene, polymers of chlorotrifluoroethylene, fluorinated ethylene-propylene polymers, polyvinylidene fluoride, hexafluoropropylene, and other elastomeric high polymers containing fluorene, also known and referred to as fluoroelastomers.

The term "semi-conductive" refers to the electrical resistivity of a conductive material whose resistivity at room temperature (70° F.) is in the range $10^{-2}$ ohms-centimeter to $10^{9}$ ohms-centimeter, which is between the resistivity of metals and insulators. The term "support cylinder" as used herein refers to transfer cylinders, delivery cylinders, support rollers, guide wheels, transfer drums and the like.

For exemplary purposes, the invention will be described with reference to sheet material. However, it will be understood that the principles of the invention are equally applicable to web substrates.

The improved method and apparatus for handling a processed substrate in accordance with the present invention may be practiced in combination with high speed printing press equipment of the type used, for example, in offset printing. Such equipment may include one or more support cylinders 10 for handling a processed substrate such as a freshly printed sheet between printing units and upon delivery of the printed sheet to a delivery stacker.

The particular location of the improved support cylinder 10 of the present invention at an interstation transfer position (T1, T3) or at a delivery position (T4) in a typical rotary offset printing press 12 is believed to be readily understandable to those skilled in the art. In any case, reference may be made to my earlier U.S. Pat. Nos. 3,791,644 and 4,402,267 which disclose details regarding the location and function of a sheet support cylinder in a typical multistation printing press. The present invention may, of course, be utilized with conventional printing presses having any number of printing units or stations.

Figure 1:
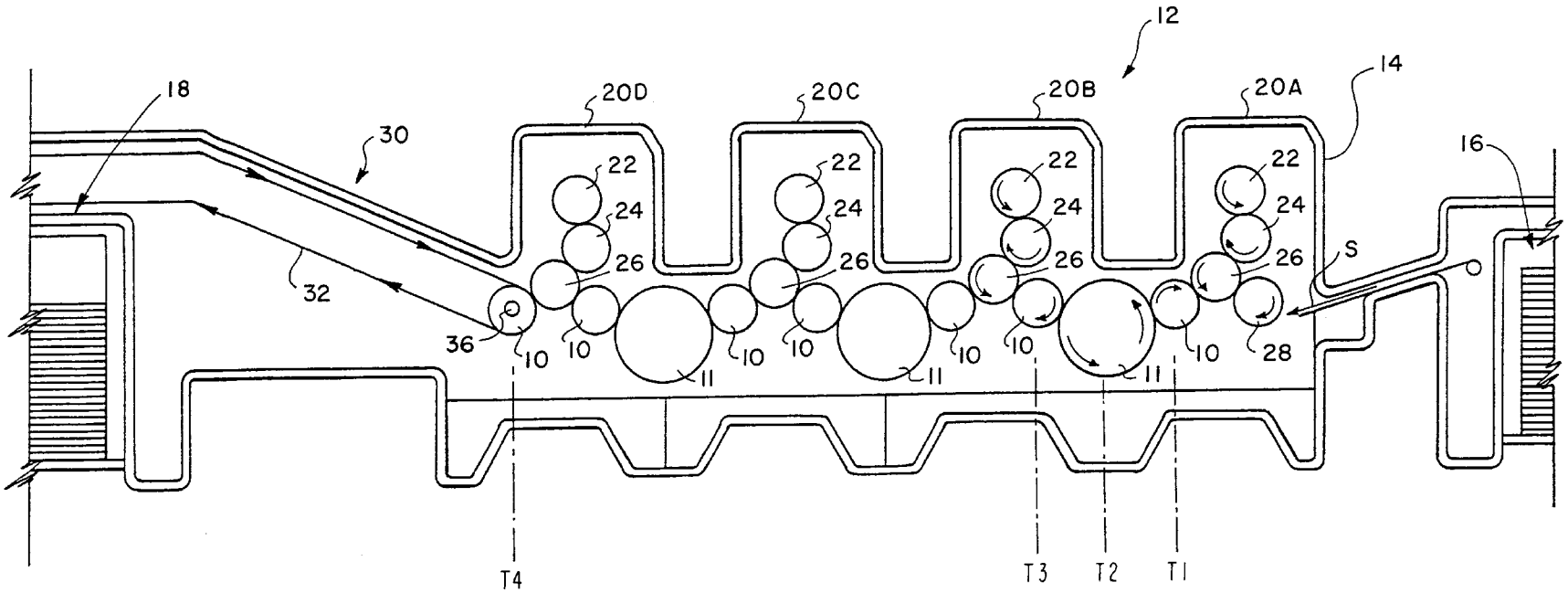
FIG. 1 is a schematic side elevational view in which multiple support cylinders of the present invention are installed at interstation positions in a four color rotary offset printing press.

Referring to FIG. 1, the press 12 includes a press frame 14 coupled on its input end to a sheet feeder 16 from which sheets, herein designated S, are individually and sequentially fed into the press. At its delivery end, the press 12 is coupled to a sheet stacker 18 in which the printed sheets are collected and stacked. Interposed between the sheet feeder 16 and the sheet stacker 18 are four substantially identical sheet printing units 20A, 20B, 20C, and 20D which are capable of printing different color inks onto the sheets as they are transferred through the press.

As illustrated in FIG. 1, each printing unit is of conventional design, and includes a plate cylinder 22, a blanket cylinder 24 and an impression cylinder 26. Freshly printed sheets S from the impression cylinder are transferred to the next printing unit by a transfer cylinder 10. The initial printing unit 20A is equipped with a sheet in-feed roller 28 which feeds individual sheets one at a time from the sheet feeder 16 to the initial impression cylinder 26.

The freshly printed sheets S are transferred to the sheet stacker 18 by a delivery conveyor system, generally designated 30. The delivery conveyor 30 is of conventional design and includes a pair of endless delivery gripper chains 32 carrying transversely disposed gripper bars, each having gripper elements for gripping the leading edge of a freshly printed sheet S as it leaves the impression cylinder 26 at the delivery position T4. As the leading edge of the printed sheet S is gripped by the grippers, the delivery chains 32 pull the gripper bars and sheet S away from the impression cylinder 26 and transport the freshly printed sheet S to the sheet delivery stacker 18.

An intermediate transfer cylinder 11 receives sheets printed on one side from the transfer cylinder 10 of the preceding printing unit. Each intermediate transfer cylinder 11, which is of conventional design, typically has a diameter twice that of the transfer cylinder 10, and is located between two transfer cylinders 10, at interstation transfer positions T1, T2 and T3, respectively. The impression cylinders 26, the intermediate transfer cylinders 11, the transfer cylinders 10, as well as the sheet in-feed roller 28, are each provided with sheet grippers which grip the leading edge of the sheet to pull the sheet around the cylinder in the direction as indicated by the associated arrows. The transfer support cylinder 10 in the delivery position T4 is not equipped with grippers, and includes instead a large longitudinal opening A which provides clearance for passage of the chain driven delivery conveyor gripper bars.

The function and operation of the transfer cylinders and associated grippers of the printing units are believed to be well known to those familiar with multi-color sheet fed presses, and need not be described further except to note that the impression cylinder 26 functions to press the sheets against the blanket cylinders 24 which applies ink to the sheets, and the transfer cylinders 10 guide the sheets away from the impression cylinders with the wet printed side of each sheet facing against the support surface of the transfer cylinder 10. Since each transfer cylinder 10 supports the printed sheet with the wet printed side facing against the transfer cylinder support surface, the transfer cylinder 10 is provided with a low coefficient of friction, electrically semi-conductive cylinder base covering as described below.

Figure 2:
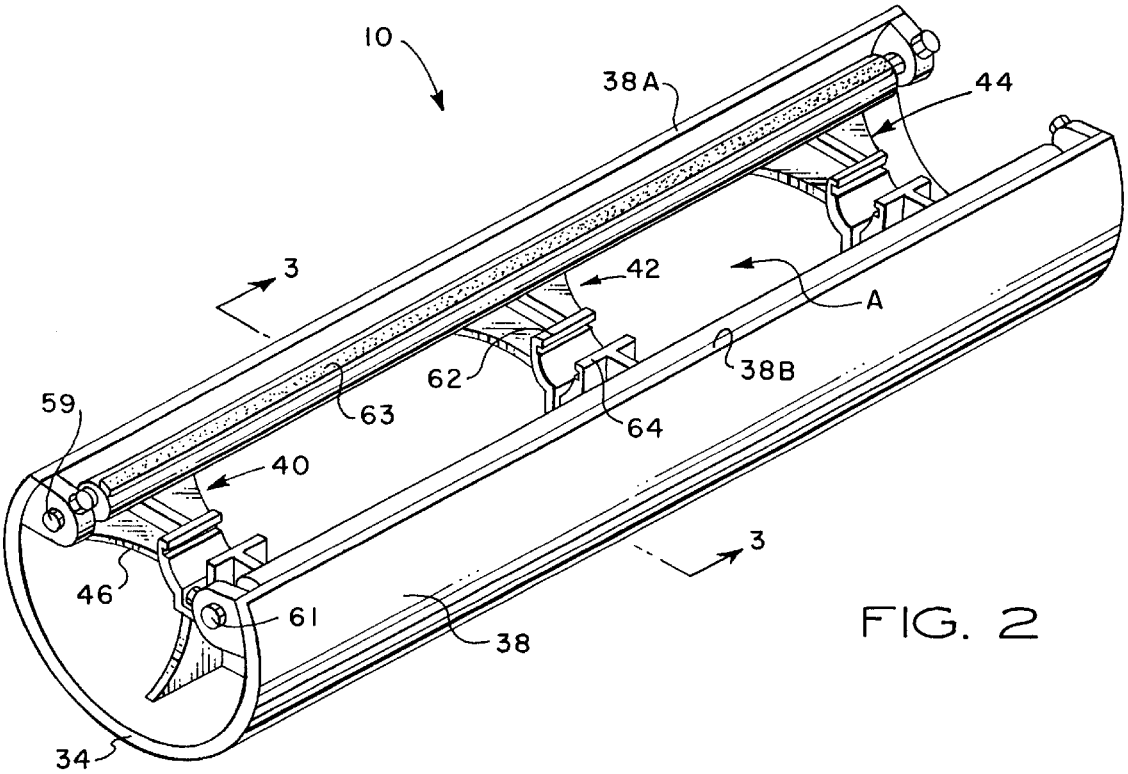
FIG. 2 is a perspective view of a delivery cylinder.
Figure 3:
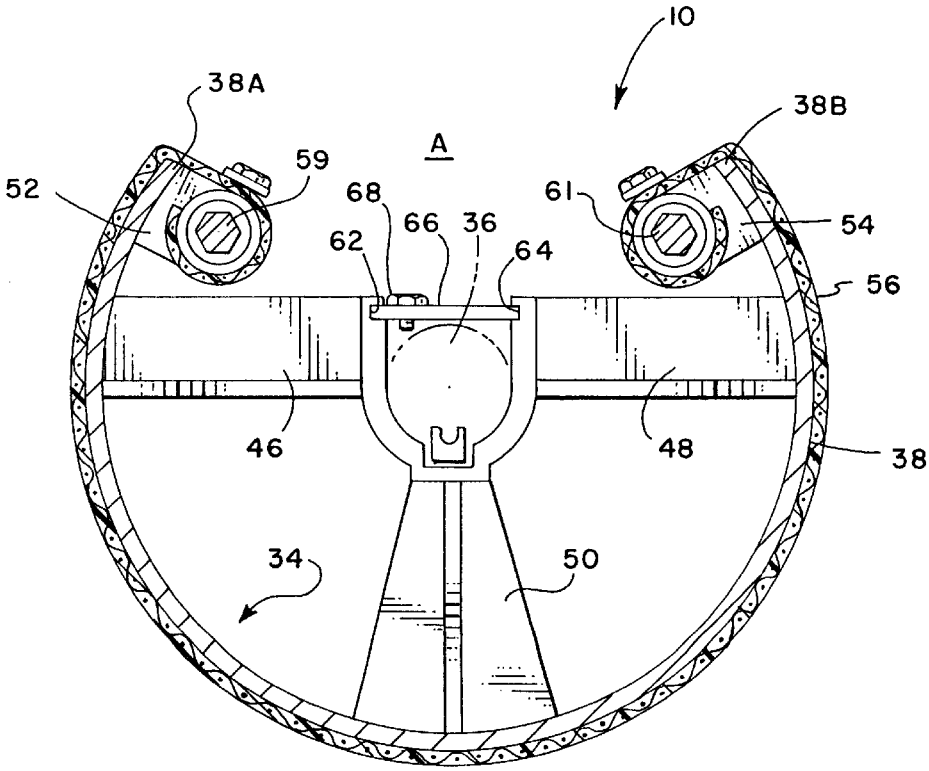
FIG. 3 is a sectional view showing a semi-conductive base covering installed on the sheet support surface of the delivery cylinder, taken along the line 3—3 of FIG. 2.

Referring now to FIG. 1, FIG. 2 and FIG. 3, an improved transfer support cylinder 10 adapted for use in the delivery position (T4) is characterized by a cylindrical portion 34 which is mountable on the press frame 14 by a shaft 36. When the transfer cylinder is adapted for use in the delivery position (T4), it will be referred to as the "transfer delivery cylinder". The external cylindrical surface 38 of the cylindrical portion 34 has an opening A extending along the longitudinal length of the transfer delivery cylinder between leading and trailing edges 38A, 38B, respectively. The transfer delivery cylinder 10 includes longitudinally spaced hub portions 40, 42, 44 which may be integrally formed with the cylindrical portion 34.

Each hub portion is connected to the cylinder 34 by webs 46, 48 and 50, and support the transfer delivery cylinder 10 for rotation on the shaft 36 on a printing press in a manner similar to the mounting arrangement disclosed in U.S. Pat. No. 3,791,644. As shown in FIG. 2, the transfer delivery cylinder 10 includes opposed elongated integral flange members 52, 54 which extend radially inwardly from the surface of the cylinder 34. The flange portions 52 and 54 include elongated flat surfaces for securing a low coefficient of friction, semi-conductive base covering 56 as described below.

Referring now to FIG. 2 and FIG. 3 of the drawings, there is illustrated in detail the improved construction of the transfer delivery cylinder 10 of the present invention including the semi-conductive base covering 56 for providing supporting contact for the printed side of a sheet S while guiding the printed sheet to the next printing unit or to the press delivery stacker. Although the ink repellent flexible jacket covering disclosed in my U.S. Pat. No. 4,402,267 provided improvements in transferring freshly printed sheet material, we have discovered that virtually smear-free sheet transfer can be obtained without using the flexible jacket covering. Instead, an electrically semi-conductive, low friction base covering on the supporting surface 38 of the delivery cylinder supports and guides successive sheets of printed material without transferring the wet ink from a previous sheet to successive sheets and without marking or depressing the surface of the freshly printed sheet.

Figure 4:
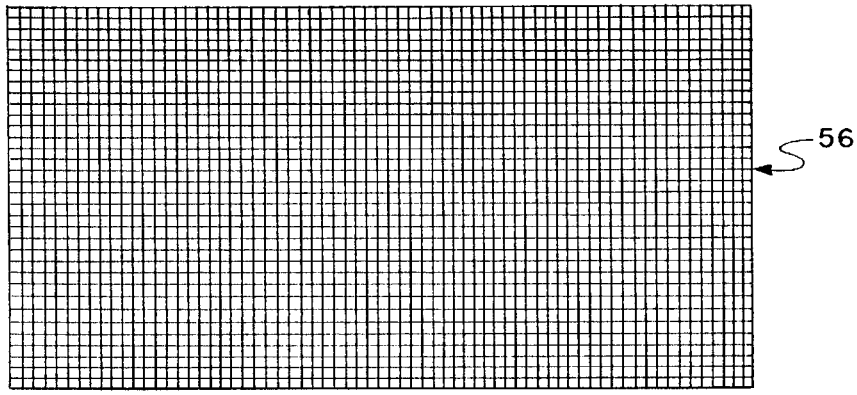
FIG. 4 is a top plan view of a semi-conductive base covering.
Figure 5:
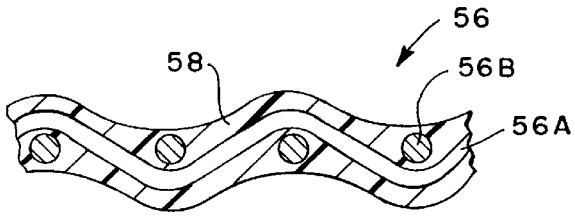
FIG. 5 is a simplified sectional view thereof showing weft and warp strands.

In accordance with one aspect of the present invention, it has been determined that a semi-conductive resin compound, preferably a dielectric resin containing a conductive agent, has produced a substantial improvement in the transferring of printed sheet material that has wet ink on one surface thereof as it passes over and is supported by the transfer delivery cylinder 10. A suitable semi-conductive base covering 56 in accordance with the present invention and illustrated in the embodiment of FIG. 5 comprises a woven material having warp and weft strands 56A, 56B which are covered with a semi-conductive compound 58. The semiconductive base covering 56 is attached to the flanges 52 and 54 and is wrapped around the cylinder support surface 38, as shown in FIG. 3. The semi-conductive base covering 56 is preferably of rectangular shape as shown in FIG. 4 and FIG. 5, and is dimensioned to completely cover the external cylindrical support surface 38 of the cylinder 34.

Preferably, the semi-conductive compound 58 is polytetrafluoroethylene resin (PTFE), for example as sold under the trademarks TEFLON and XYLAN, which is impregnated with a conductive agent. The cylinder base covering material 56 comprises warp and weft (fill) strands 56A, 56B of polyamide fiberglass, woven together in a base fiber thickness of approximately 0.007 inch. The woven material is coated with semi-conductive PTFE to a finished thickness in the range of 0.009–0.011 inch, a finished weight in the range of 17–20 ounces per square yard, with a tensile strength of approximately 400×250 warp and weft (fill) (pounds per square inch). In one embodiment, the polyamide fiber comprises woven fiberglass filaments 56A, 56B covered by semi-conductive PTFE according to MIL Standard Mil-W-18746B. The PTFE resin compound 58 contains electrically conductive carbon black, or some other equivalent conductive agent such as graphite or the like, preferably in an amount sufficient to provide a surface resistivity not exceeding approximately 100,000 ohms-centimeter.

While polyamide fiber covered or coated with polytetrafluoroethylene (PTFE) resin or a fluorinated ethylene propylene (FEP) resin impregnated with carbon black is preferred, other synthetic or natural organic resins including linear polyamides such as that sold under the trade name NYLON, linear polyesters such as polyethylene terephthlate sold under the trade name MYLAR, hydrocarbon or halogenated hydrocarbon resins such as polyethylene, polypropylene or ethylene-propylene copolymers, and acrylonitrile butadinene styrene (ABS) have a low coefficient of friction surface and can also be combined with a conductive agent, such as carbon black, graphite or the like, to render the compound electrically conductive.

In the preferred embodiment, the surface resistivity of the conductive base covering 56 is approximately 75,000 ohms-centimeter. Other surface resistivity values may be used to good advantage, for example in the surface resistivity range of 50,000 ohms-centimeter to 100,000 ohms-centimeter. The coefficient of friction and conductivity of the base covering material are influenced by the presence of the conductive agent. Consequently, the amount of conductive agent included in the fluoropolymer resin for a given conductivity or surface resistivity will necessarily involve a compromise with the coefficient of friction. Generally, high conductivity (low surface resistivity) and low coefficient of friction are desired. The amount of conductive agent contained in the fluoropolymer resin preferably is selected to provide a surface resistivity not exceeding approximately 75,000 ohms-centimeter and a coefficient of friction not exceeding approximately 0.110.

Referring to FIG. 2 and FIG. 3, the semi-conductive base covering 56 is secured to the transfer delivery cylinder 10 by ratchet clamps 59, 61.

An important aspect of the present invention concerns reducing the coefficient of friction of the support surface 38 of the cylinder 34. The improved cylinder base support surface has a coefficient of friction less than the frictional coefficient of the cylinder surface 38 such as may be provided by coating the external surface 38 of the cylinder 34 with a fluoropolymer, but which has structurally differentiated surface portions which reduce the surface area available for frictional contact against the freshly printed sheets. It has been discovered that the radially projecting surface portions of the embodiments of FIGS. 5, 7, 8, 9 10, 11 and 12 provide improved, low frictional slip surfaces which perform substantially better in reducing accumulation of ink deposits on the base support surface 38 of the transfer cylinder 10.

Figure 6:
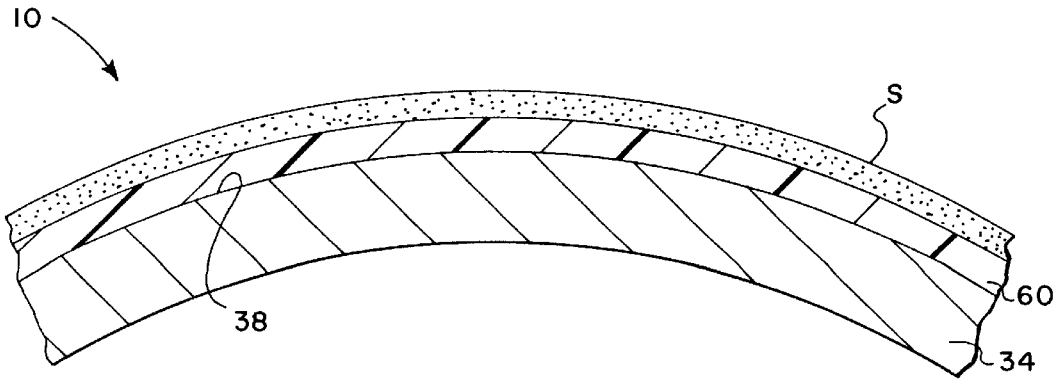
FIG. 6 is an enlarged sectional view, partially broken away, of the delivery cylinder of FIG. 2 having a semi-conductive base covering in the form of a layer of fluorinated polymer resin which is impregnated by a conductive agent.

Referring to FIG. 6, a low friction, semi-conductive base covering is also provided by a semi-conductive coating layer 60 applied directly on the cylinder support surface 38. The coating layer 60 comprises fluorocarbon composite coating material containing a conductive agent is applied in a layer to the support surface 38 of the cylinder 34. A preferred conductive composition for providing the layer 60 is a polytetrafluoroethylene (PTFE) resin made under the trademark XYLAN by the Whitford Corporation, Westchester, Pa., impregnated with carbon black. A satisfactory coating type is XYLAN 1010 composite coating material which is curable at low oven temperatures, for example 250° F.

The preparation of the conductive base layer 60 as described provides a substantially glazed surface having a low coefficient of friction of about 0.110, which is semi-conductive (surface resistivity of about 75,000 ohms-centimeter) and also provides for ease of movement of the freshly printed sheets by eliminating electrostatic cling. Although the low friction, conductive fluoropolymer layer 60 is particularly advantageous, it is contemplated that other semi-conductive coatings may be applied to the transfer cylinder surface 38 to produce a comparable low friction, semi-conductive support surface.

Both the woven semi-conductive base covering 56 (FIG. 3) and the semi-conductive base layer 60 (FIG. 6) have provided the improvement of reducing ink marking in high speed printing equipment and have also eliminated depressions and indentations in the paper surface of the sheets.

Figure 7:
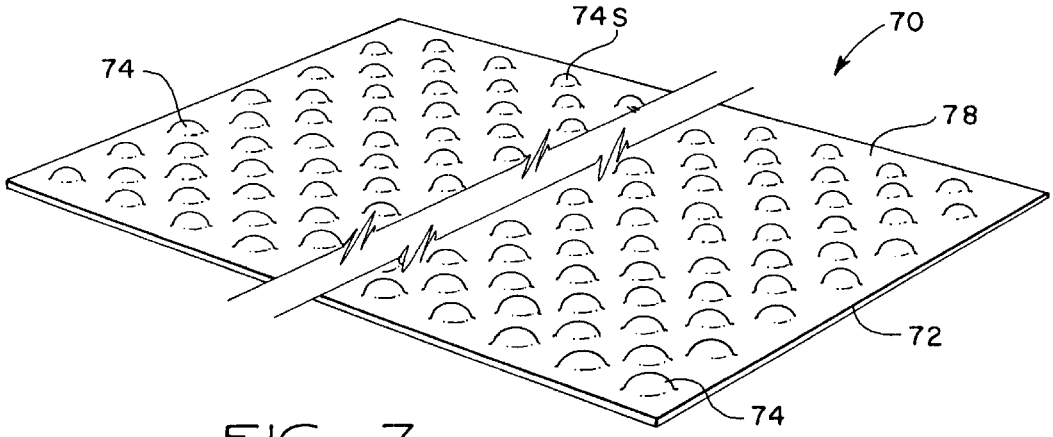
FIG. 7 is a perspective view showing an alternative embodiment of a semi-conductive base covering having radially projecting nodes.
Figure 8:
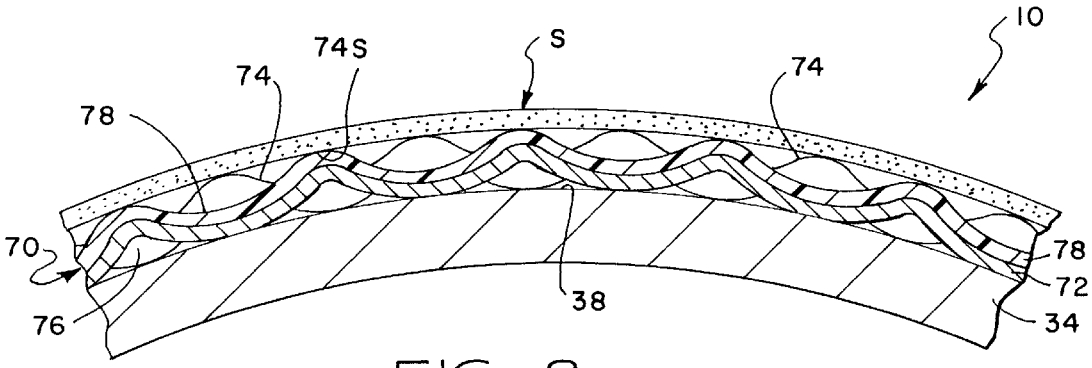
FIG. 8 is a sectional view showing the semi-conductive base covering of FIG. 7 installed on a delivery cylinder.

Referring now to FIG. 7 and FIG. 8, an alternative embodiment of a base covering is illustrated. In that embodiment, a base covering 70 comprises a carrier sheet 72, formed of a moldable material such as plastic or the like. According to an important aspect of this alternative embodiment, the carrier sheet 72 is molded or formed to produce multiple nodes or radial projections 74 on the sheet engaging side of the carrier sheet 72. Each node 74 has a curved, sheet engageable surface 74S which is radially offset with respect to the curved transfer path of the sheet S.

Preferably, the nodes 74 and the surface of the carrier sheet 72 are covered by a layer 78 of a semi-conductive, low friction resin compound, for example, a fluoropolymer impregnated with a conductive agent such as carbon black or graphite. Polytetrafluoroethylene (PTFE) impregnated with carbon black is preferred for this embodiment, and is applied in a layer directly onto the surface of the carrier sheet 72 as previously described. The nodes 74 have a radial projection with respect to the carrier sheet 72 of approximately four mils with a circumferential spacing between each node of approximately two mils. The carrier sheet 72 is electrically connected to the cylinder 34 through the ratchet clamps 59, 61. The low friction, semi-conductive coating 78 is applied directly to the carrier sheet, whereby electrical charges delivered by the printed sheet S are conducted through the carrier sheet 72 into the cylinder 34 and into the grounded press frame 14.

The carrier sheet 72 should have a gauge thickness which is sufficient to provide strength and dimensional stability and yet be flexible enough to easily wrap around the ratchet wheel and the support cylinder 34. Generally, gauge thicknesses in the range of about 2 mils to about 24 mils may be used to good advantage, depending on press clearance and press design.

Referring again to FIG. 8, one advantage provided by the node embodiment is reduced surface contact between the freshly printed sheets and the base covering 70. Because of the curved contour of the nodes 74 and the node spacing, there is less surface area available for contact by the freshly printed sheets. Consequently, the force of frictional engagement is substantially reduced, thus permitting flexible movement of the freshly printed sheets relative to the transfer cylinder base covering.

Figure 9:
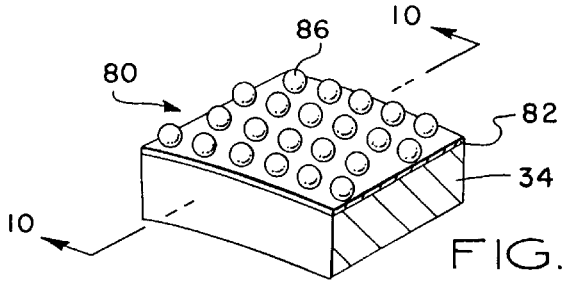
FIG. 9 is a perspective view of a portion of the delivery cylinder of FIG. 2 whose transfer surface is covered by a layer of semi-conductive beads.
Figure 10:
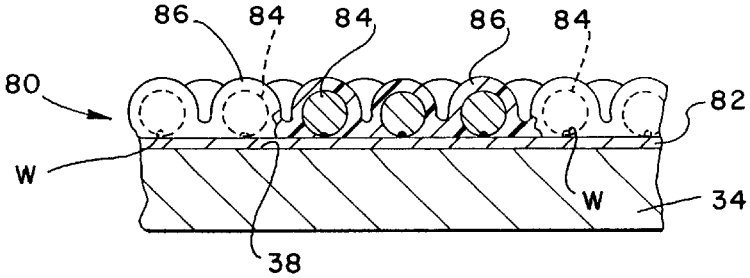
FIG. 10 is a longitudinal sectional view thereof.

Referring now to FIG. 9 and FIG. 10, yet another semi-conductive base covering embodiment is illustrated. In this embodiment, a low friction, semi-conductive base covering 80 comprises a metallic carrier sheet 82, constructed of a malleable metal such as aluminum, copper, zinc or the like. The conductive carrier sheet 82 has multiple beads 84 secured to its external surface by electrical weld unions W. The surface of the conductive carrier sheet 82 and the beads 84 are covered by a layer 86 of a fluoropolymer resin which contains a semi-conductive agent, for example polytetrafluoroethylene resin (PTFE) containing carbon black, as previously specified. The beads may be formed of a metal such as aluminum, copper, zinc or the like, or other material such as nylon polyamide resin.

The beads 84 have a diameter of approximately six mils, and the thickness of the low friction, semi-conductive coating layer 86 is approximately 2 mils. Preferably, the coated beads are arranged in a rectilinear pattern and are circumferentially spaced with respect to each other by approximately 3 mils. The gauge thickness of the conductive carrier sheet 82 is in the range of approximately 2 mils to approximately 24 mils, depending on press clearance and design.

The spacing and curvature of the coated beads reduces the amount of surface available for contact with the freshly printed sheets. The low friction surface provided by the PTFE resin layer 86, together with the circumferential spacing, and radially projecting portions of the beads substantially reduce the area of frictional engagement, thus reducing surface contact between the freshly printed sheets and the underlying cylinder base covering 80.

Figure 11:
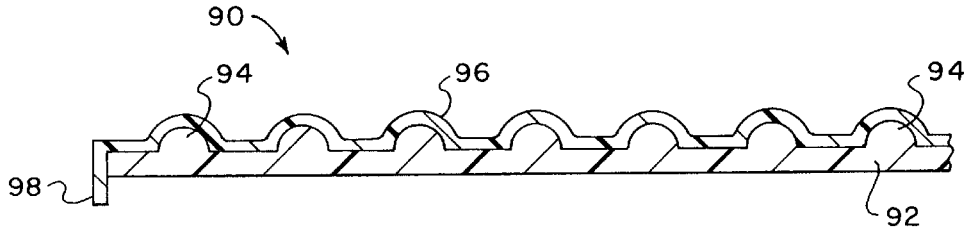
FIG. 11 is a sectional view showing an alternative embodiment of a semi-conductive base covering having radially projecting nodes.
Figure 12:
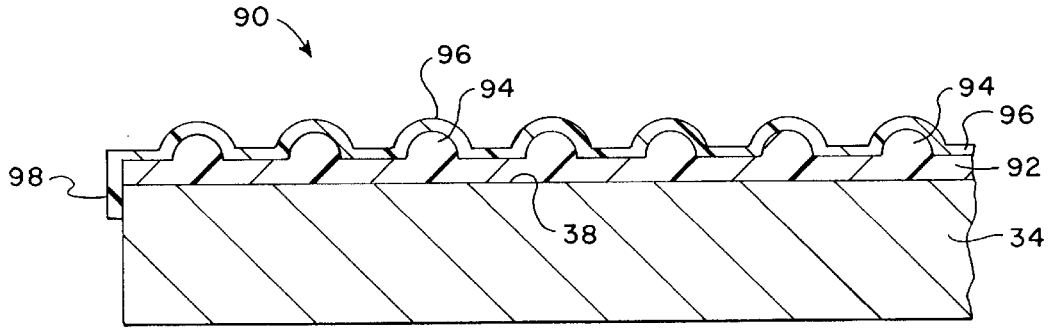
FIG. 12 is a sectional view showing the conductive base covering of FIG. 11 installed on a delivery cylinder.

Yet another embodiment of a low frictional slip, conductive base covering is shown in FIG. 11 and FIG. 12. In this alternative embodiment, a conductive base covering 90 comprises a base carrier sheet 92 of a moldable, plastic material having integrally formed spherical projections 94 arranged in a rectilinear array. The base carrier sheet 92 and the spherical projections 94 are covered by a semi-conductive layer or coating 96 of a fluoropolymer resin which contains a conductive agent, for example polytetrafluoroethylene resin (PTFE) containing carbon black or graphite, as previously specified.

In the molded carrier sheet embodiment shown in FIG. 11 and FIG. 12, the semi-conductive layer or coating 90 is secured in electrical contacting engagement with the cylinder 34 by a linking portion 98. The coated, spherical projections 94 are spaced with respect to each other by approximately 3 mils. The gauge thickness of the base carrier sheet 92 is in the range of approximately 2 mils to as much as 24 mils or more, subject to press clearance. The spherical projections 94 have a radius of approximately 3 mils, and the thickness of the low friction, conductive coating layer 96 is approximately 2 mils. The radially projecting portions 94 substantially reduce the surface area available for contact, thus reducing frictional engagement between the freshly printed sheets and the base covering 90.

The woven embodiment of FIG. 5 and the node embodiments of FIG. 7 through FIG. 12 reduce the amount of surface available for contact with the freshly printed sheets. For example, the overlapping warp and weft (fill) strands 56A, 56B of the woven embodiment shown in FIG. 5A provide a lattice-like framework of radially projecting lattice portions that reduce the surface area available for frictional engagement. The low frictional coefficient support function is also provided by the radially projecting node embodiments of FIGS. 7–12.

An additional advantage provided by the foregoing embodiments is that the structurally differentiated and radially projecting surface portions provided by the woven material and by the nodes concentrate or focus the area of electrostatic discharge between the freshly printed sheets and the semi-conductive base covering. The raised or projecting surfaces associated with the woven material and the nodes provide reduced area discharge points or electrostatic precipitation points where the electric field intensity is increased, thus enhancing the conduction of electrostatic charge from the freshly printed sheets through the semi-conductive base covering, into the cylinder 34 and into the grounded press frame 14.

Figure 13:
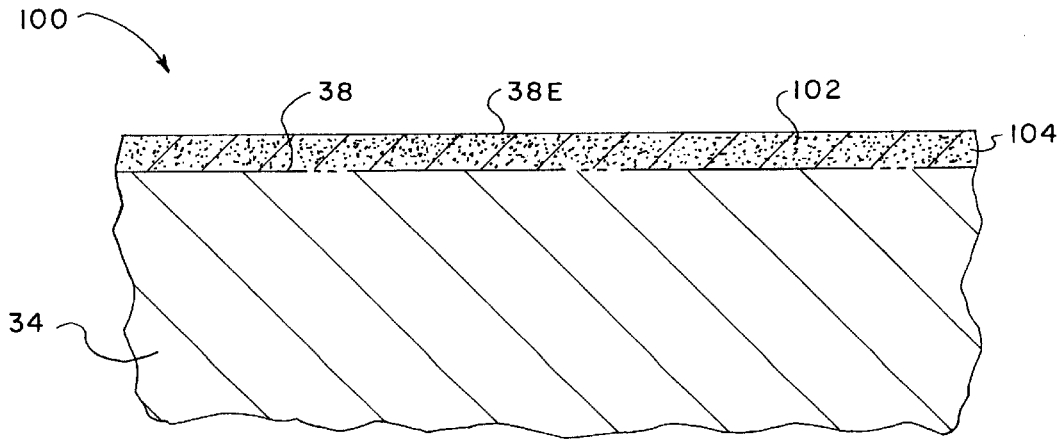
FIG. 13 is an enlarged sectional view, partially broken away, of a delivery cylinder having a semi-conductive transfer surface which is infused with low friction polymeric particles.

Referring now to FIG. 13, yet another semi-conductive base covering embodiment is illustrated. In this embodiment, a low friction, semi-conductive base covering 100 comprises an infusion of organic lubricant particles 102, preferably polytetrafluoroethylene (PTFE) which are infused into the support surface 38 of the cylinder 34. The support surface 38 is covered or plated by a porous, thin metal film 104, with the PTFE particles being infused through the porous layer, and partially into the cylinder 34, thus providing a semi-conductive base support surface 38E which has a low coefficient of friction, and which has a surface resistivity in the range of from 50,000 ohms-centimeter to about 100,000 ohms-centimeter.

The infusion of a low friction coefficient, organic lubricant material such as PTFE is carried out by providing a thin metal film coating 104 of a porous alloy of nickel or cobalt, or the like, with boron or the like, which is electrochemically deposited on the cylinder surface 38. The cylinder 34 is immersed in a catalytic nucleation plating bath containing a nickel salt and a borohydrite reducing agent, with the plating rate being adjusted to provide a nickel-boron coating layer 104 at a plating deposition rate on the order of approximately 1–2 mils/hour. The plating nucleation is terminated after the coating layer 104 has formed a metallurgical union with the cylinder surface 38, but where the coating layer 104 still retains voids that provide a porosity of the order of about 20%–50%, and having a radial thickness of approximately one mil or less.

After rinsing and drying, the nickel-boron thin film 104 is heat treated to improve metal bond integrity and to increase the hardness of the porous thin film layer 104 from about 58–62 Rockwell "C" to about 70–72 Rockwell "C". The heat treatment is preferably carried out at a temperature of approximately 650° F.

A low friction coefficient organic lubricant material, for example PTFE, is then applied to the porous surface 38E, and is further heat treated to cause the organic lubricant material to flow into the voids of the porous alloy layer 104. Preferably, the organic lubricant material is infused during the heat treatment at higher temperatures above the melting point of the organic lubricant (preferably at a temperature in the range of approximately 580° F. to approximately 600° F. for polytrafluoroethylene) to cause mixing, flow and infusion until the voids of the porous metal film coating 104 are completely filled, thus providing a reservoir of organic lubricant material.

After infusion of the organic lubricant 102, the surface 38E is burnished and polished to remove excess material, exposing the bare metal alloy surface 38E and pores which have been filled with the organic lubricant. The result is a hardened surface 38E which has a coefficient of friction lower than that of the cylinder surface 38 and is electrically semi-conductive.

Figure 14:
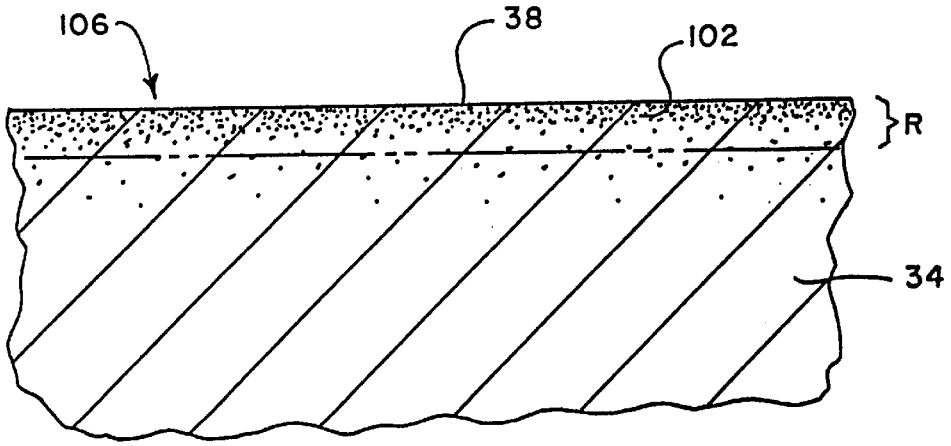
FIG. 14 is an enlarged sectional view, partially broken away, of a delivery cylinder having a semi-conductive transfer surface which is infused with low friction polymeric particles; and, FIG. 15 is a greatly enlarged pictorial representation of a microscopic section taken through an external, semi-conductive region of the delivery cylinder of FIG. 14.
Figure 15:
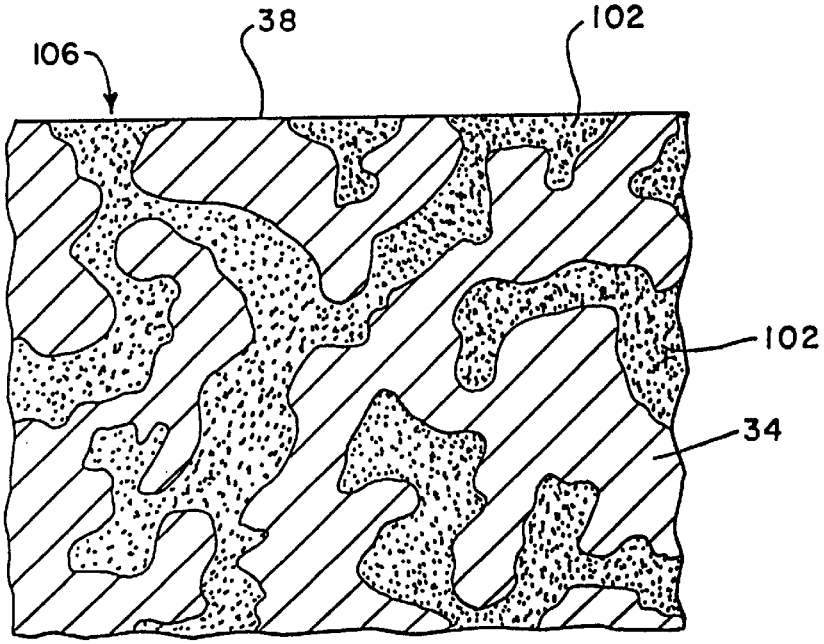

Referring now to FIG. 14 and FIG. 15, an alternative semi-conductive base covering embodiment is illustrated. In this embodiment, the cylinder 34 itself is constructed of a porous metal, for example cast iron. Cast iron is considered to be relatively porous as compared with extruded aluminum, for example. The organic lubricant particles 102 are infused directly into the porous surface region R underlying the support surface 38. The infusion of lubricant 102 is concentrated in the porous surface region R, preferably to a penetration depth of about 0.001 inch. The organic lubricant particles 102 preferably comprise polytetrafluoroethylene (PTFE).

After cleaning, rinsing, and drying the surface 38 of the cylinder 34, the cylinder is heated in an oven at a pre-bake burn-off temperature of about 650° F. to drive off oils and other volatiles from the porous surface region R. The heating step opens and expands the pores in the surface region of the cylinder. While the cylinder 34 is still hot, an organic lubricant, for example PTFE particles suspended in a liquid carrier, are sprayed onto the heated surface 38. After the surface 38 has been thoroughly wetted by the liquid organic lubricant solution, it is placed in an oven and heated at a temperature above the melting point of the organic lubricant (preferably at a temperature on the order of approximately 580° F. to approximately 600° F. for polytetrafluoroethylene) to cause mixing, flow and infusion into the surface pores of the cylinder 34 until the voids in the surface region R are completely filled with the PTFE particles 102. As a result of such heating, the PTFE particles melt and coalesce, while the solvent is boiled and removed by evaporation. After cooling, the surface pores of the cylinder 34 are completely filled with solidified organic lubricant, substantially as shown in FIG. 15.

After infusion and solidification of the organic lubricant 102, the surface 38 is burnished and polished to remove excess material so that the bare metal surface 38 is exposed and the solid lubricant filling in each pore is flush with the bare metal surface 38. That is, any lubricant material 102 or other residue which forms a bridge over the metal surface 38 is removed and the external face of the solidified organic lubricant deposit 102 is leveled with the exposed metal surface 38. The porous near surface region which is filled with solidified organic lubricant provides a semi-conductive zone for conducting electrostatic charges from the freshly printed sheets through the conductive transfer cylinder and into the grounded press frame.

TECHNICAL ADVANTAGES OF THE INVENTION

The present invention provides a substantially improved yet simple and reliable transfer cylinder and sheet handling apparatus which is adapted to support the freshly printed surface of a printed sheet, without smearing or marking the printed surface and without damaging the printed material. The improved support cylinder of the present invention is easily installed on conventional printing presses.

The freshly processed substrates and the low coefficient of friction, semi-conductive base covering on the cylinder surface are electrostatically neutralized with respect to each other, so that the freshly processed substrates remain movable and do not cling to the semi-conductive base support surface of the cylinder. Another beneficial result of the neutralizing action is that the underlying base support surface becomes more resistant to ink accumulation and encrustation. Yet another advantage of the electrostatically neutralized substrate material is that it retains its natural flexibility and movability in the absence of electrostatic charge accumulation. Good flexibility of the freshly processed substrate is essential to prevent concentration of surface engagement, thus avoiding marking and smearing.

Because of the selected polymeric materials used in the construction of the semi-conductive base covering, the support cylinder has longer wear life, requires less cleaning, and provides greater operating efficiencies. Since the fluorocarbon polymer surface of the semi-conductive base covering is both oleophobic and hydrophobic, it resists wetting. It is not necessary to wash the semi-conductive base support surface of the cylinder since the semi-conductive covering is ink repellent and resists the accumulation of ink, thus reducing maintenance time and labor, while improving quality and increasing productivity.

Removal of the static charge from freshly printed sheets makes sheet handling easier at the delivery unit. By eliminating the electrostatic charge on the freshly printed sheet, the printed sheet is more easily jogged to achieve a uniform stack of sheets. Another significant advantage is that offset or set-off in the delivery stacker is reduced because the electrostatically neutralized printed sheets may be delivered gently and uniformly into the delivery stacker. The electrostatic charges are removed from the freshly printed sheets as they are transferred through the press, so that each printed sheet is neutralized as it is delivered to the stacker.

Those skilled in the art will appreciate that various modifications to the method and apparatus of the present invention may be made without departing from the spirit and scope of the present invention as defined by the appended claims.

What is claimed is:

1. A method for supporting a processed substrate as it is transferred from a processing unit of a printing press, comprising the steps of:

providing a rotatable member having a substrate support surface thereon;

providing a base covering of electrically semi-conductive material having a frictional coefficient which is less than the frictional coefficient of the substrate support surface;

securing the semi-conductive base covering around the substrate support surface and in electrical contact with the rotatable member; and, rotating the rotatable member to support a processed substrate on the semi-conductive base covering.

2. The method as set forth in claim 1, wherein the semi-conductive base covering comprises a sheet of woven material which is covered with a semi-conductive compound, wherein the step of securing the semi-conductive covering to the rotatable member is performed by wrapping the semi-conductive covering around the substrate support surface.

3. The method as set forth in claim 1, wherein the base covering comprises a layer of semi-conductive material, and the step of securing the conductive layer is performed by applying the conductive material directly onto the substrate support surface.

4. The method as set forth in claim 1, wherein the base covering comprises a sheet of woven material having warp and weft strands, the warp and weft strands being covered with a coating of semi-conductive material, including the step of engaging the substrate against the coated warp and weft strands.

5. The method as set forth in claim 1, wherein the base covering comprises a carrier sheet having radially projecting, circumferentially spaced nodes, with the nodes being covered by a coating of semi-conductive material, including the step of engaging the substrate against the coated nodes.

6. The method as set forth in claim 1, wherein the base covering is a carrier sheet having an array of beads which are circumferentially spaced and disposed on the surface of the carrier sheet and covered by a coating of semi-conductive material, including the step of engaging the substrate against the coated beads.

7. In the operation of a printing press having a support cylinder mounted adjacent to an impression cylinder for guiding a freshly processed substrate, the improvement comprising the step of discharging electrostatic charges from the freshly processed substrate through a semi-conductive base covering disposed on the support cylinder.

8. The method as set forth in claim 7, wherein the conductive base covering comprises a sheet of woven material having warp and weft strands which are covered by a semi-conductive material, including the step of concentrating the area of electrostatic discharge by engaging the freshly processed substrate against radially projecting portions of the warp and weft strands.

9. The method as set forth in claim 7, wherein the conductive base covering comprises a carrier sheet having radially projecting, circumferentially spaced nodes which are coated with a semi-conductive material, including the step of concentrating the area of electrostatic discharge by engaging the freshly processed substrate against the coated nodes.

10. The method as set forth in claim 7, wherein the conductive base covering is a carrier sheet having an array of metal beads which are circumferentially spaced and disposed in electrical contact on the surface of the carrier sheet, and which are coated with a semi-conductive material, including the step of concentrating the area of electrostatic discharge by engaging the freshly processed substrate against the coated beads.

11. A method for handling a printed substrate in a rotary offset press having multiple printing units, each printing unit employing a blanket cylinder and an impression cylinder for printing an image onto one side of a substrate transferring between, comprising the following steps performed at each printing unit in succession:

transferring printing ink from an image area on the blanket cylinder onto a substrate as the substrate is transferred through the nip between the impression cylinder and the blanket cylinder;

gripping and transferring the freshly printed substrate from the impression cylinder;

guiding the freshly printed substrate around a support cylinder as the freshly printed sheet is transferred from the impression cylinder;

supporting the freshly printed side of the substrate on a semi-conductive base covering disposed on the support cylinder;

conducting electrostatic charges from the freshly printed substrate to the semi-conductive base covering; and, conducting electrostatic charges from the semi-conductive base covering to the support cylinder.

12. The method as set forth in claim 11, wherein the semi-conductive base covering has structurally differentiated surface portions defining electrostatic precipitation points, and the step of conducting electrostatic charges is performed by discharging electrostatic charges from the freshly printed substrate through the electrostatic precipitation points.

13. The method as set forth in claim 11, wherein the semi-conductive base covering comprises a sheet of woven material having warp and weft portions defining electrostatic precipitation points which are covered by a semi-conductive coating, and the discharging step is performed by engaging the freshly printed substrate against the coated warp and weft portions.

14. The method as set forth in claim 11, wherein the base covering comprises a carrier sheet having radially projecting, circumferentially spaced nodes defining electrostatic precipitation points which are covered with a semi-conductive coating, and the discharging step is performed by engaging the freshly printed substrate against the coated nodes.

15. The method as set forth in claim 11, wherein the base covering is a carrier sheet having an array of beads defining electrostatic precipitation points which are circumferentially spaced and disposed in electrical contact with the carrier sheet, and wherein said beads are covered with a semi-conductive coating, and the discharge step is performed by engaging the freshly printed substrate against the coated beads.

16. In a support cylinder having substrate support surface for guiding a freshly processed substrate as it is transferred from one printing unit to another, the improvement comprising:

a base covering of semi-conductive material disposed on the support cylinder, the semi-conductive base covering having a frictional coefficient which is less than the frictional coefficient of the sheet support surface.

17. The invention as set forth in claim 16, wherein the electrically semi-conductive material comprises a fluoropolymer resin containing a conductive agent.

18. The invention as set forth in claim 17, wherein the fluoropolymer resin comprises polytetrafluoroethylene (PTFE).

19. The invention as set forth in claim 17, wherein the semi-conductive agent comprises carbon black.

20. The invention as set forth in claim 17, wherein the semi-conductive agent comprises graphite.

21. The invention as set forth in claim 16, wherein the semi-conductive material comprises woven polyamide glass filaments covered with a fluoropolymer resin which contains a conductive agent.

22. The invention as set forth in claim 16, wherein the semi-conductive base covering comprises a layer of a dielectric resin containing a semi-conductive agent which is disposed on the substrate support surface of the support cylinder.

23. The invention as set forth in claim 16, wherein the semi-conductive base covering comprises a sheet of woven material having warp and weft strands covered with a semi-conductive material.

24. The invention as set forth in claim 16, wherein the semi-conductive base covering comprises a carrier sheet having radially projecting, circumferentially spaced nodes, said nodes being covered with a semi-conductive material.

25. The invention as set forth in claim 16, wherein the semi-conductive base covering comprises a metallic carrier sheet having an array of beads which are circumferentially spaced across the surface of the carrier sheet, the carrier sheet and the beads being covered by a coating of a semi-conductive material.

26. The invention as set forth in claim 16, wherein the semi-conductive base material comprises a resin selected from the group consisting of linear polyamides, linear polyesters, including polyethylene terephthalate, hydrocarbon or halogenated hydrocarbon resins including polyethylene, polypropylene and ethylene-propylene copolymers, and acrylonitrile butadiene styrene and polytetrafluoroethylene (PTFE).

27. The invention as set forth in claim 26, wherein the semi-conductive base material comprises fluorinated ethylene propylene (FEP) resin containing a conductive agent.

28. The invention as set forth in claim 26, wherein the base covering of semi-conductive material comprises a layer of porous metal disposed on the sheet support surface, the porous metal layer containing an infusion of an organic lubricant.

29. The invention as set forth in claim 28, wherein the porous layer comprises boron alloyed with a metal selected from the group consisting of nickel and cobalt.

30. The invention as set forth in claim 28, wherein the organic lubricant comprises polytetrafluoroethylene (PTFE).

31. The invention as set forth in claim 28, wherein the base covering of electrically conductive material comprises an electrochemical plating deposition of a porous metal alloy.

32. A support cylinder for guiding a freshly processed substrate as it is transferred from one printing unit to another comprising, in combination:

a rotatable support member having a porous surface region; and, an organic lubricant disposed within the porous surface region.

33. The invention as set forth in claim 32, wherein the organic lubricant comprises polytetrafluroethylene (PTFE).

34. A support cylinder for guiding a freshly processed substrate as it is transferred from one printing unit to another comprising, in combination:

a rotatable support member having a sheet support surface; and, a base covering of semi-conductive material disposed on the sheet support surface.

35. The invention as set forth in claim 34, wherein the semi-conductive material comprises a dielectric resin containing a conductive agent.

36. The invention as set forth in claim 35, wherein the dielectric resin and the amount of conductive agent contained in the dielectric resin are selected to provide the base covering with a surface resistivity not exceeding approximately 75,000 ohms-centimeter and a coefficient of friction not exceeding approximately 0.110.

37. The invention as set forth in claim 35, wherein the dielectric resin comprises a fluoropolymer selected from the group consisting of linear polyamides, linear polyesters, including polyethylene terephthalate, hydrocarbon or halogenated hydrocarbon resins including polyethylene, polypropylene and ethylene-propylene copolymers, acrylonitrile butadiene styrene, fluorinated ethylene-propylene polymers and polytetrafluoroethylene.

38. The invention as set forth in claim 35, wherein the conductive agent comprises carbon black.

39. The invention as set forth in claim 35, wherein the conductive agent comprises graphite.

40. The invention as set forth in claim 34, wherein the base covering of semi-conductive material comprises a layer of porous metal, the porous metal layer containing an infusion of an organic lubricant.

41. The invention as set forth in claim 40, wherein the porous metal comprises boron alloyed with a metal selected from the group consisting of nickel and cobalt.

42. The invention as set forth in claim 40, wherein the organic lubricant comprises polytetrafluoroethylene.

43. The invention as set forth in claim 34, wherein the base covering of semi-conductive material comprises an electrochemical plating deposition of a porous metal alloy.

* * * * *